US009103517B2

(12) United States Patent
Nakazato et al.

(10) Patent No.: US 9,103,517 B2
(45) Date of Patent: Aug. 11, 2015

(54) VEHICLE LIGHT

(75) Inventors: Yoshiaki Nakazato, Tokyo (JP); Yoshiaki Nakaya, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 16 days.

(21) Appl. No.: 13/309,542

(22) Filed: Dec. 1, 2011

(65) Prior Publication Data

US 2012/0163009 A1 Jun. 28, 2012

(30) Foreign Application Priority Data

Dec. 1, 2010 (JP) ..... 2010-268054
Feb. 9, 2011 (JP) ..... 2011-025529
Feb. 9, 2011 (JP) ..... 2011-025530

(51) Int. Cl.
*F21S 8/10* (2006.01)

(52) U.S. Cl.
CPC ..... *F21S 48/1145* (2013.01); *F21S 48/1283* (2013.01); *F21S 48/1382* (2013.01); *F21S 48/1388* (2013.01)

(58) Field of Classification Search
CPC .. F21S 48/1233; F21S 48/215; F21S 48/1382
USPC ..... 362/509–510, 545, 547
See application file for complete search history.

(56) References Cited

U.S. PATENT DOCUMENTS

2011/0063115 A1* 3/2011 Kishimoto ..... 340/600
2011/0157865 A1* 6/2011 Takahashi et al. ..... 362/84
2013/0088850 A1* 4/2013 Kroell ..... 362/84
2013/0155648 A1* 6/2013 Morgenbrod et al. ..... 362/84

FOREIGN PATENT DOCUMENTS

JP 2007-335334 A 12/2007
JP 2008-71667 A 3/2008
JP 4124445 B2 7/2008
JP 2012-74355 A 4/2012

OTHER PUBLICATIONS

List of Potentially Related Pending U.S. Appl. No. 13/309,555 to Yoshiaki Nakazato et al., filed Dec. 1, 2011.
Japanese Office Action for the related Japanese Patent Application No. 2011-025529 dated Sep. 30, 2014.
Japanese Office Action for the related Japanese Patent Application No. 2011-025530 dated Sep. 30, 2014.

* cited by examiner

*Primary Examiner* — Sean Gramling
*Assistant Examiner* — Gerald J Sufleta, II
(74) *Attorney, Agent, or Firm* — Kenealy Vaidya LLP

(57) ABSTRACT

A vehicle light can prevent color variations of the projected image. The vehicle light can include a laser diode, a wavelength conversion member including a phosphor configured to receive blue light emitted from the laser diode and then emitting white light, a projection lens configured to project the white light emitted from the wavelength conversion member to provide forward illumination for a vehicle, and a diffusing portion provided to the projection lens, configured to diffuse the excitation light which is incident on the projection lens from the wavelength conversion member.

9 Claims, 16 Drawing Sheets

VEHICLE LIGHT

This application claims the priority benefit under 35 U.S.C. §119 of Japanese Patent Application No. 2010-268054 filed on Dec. 1, 2010, Japanese Patent Application No. 2011-025529 filed on Feb. 9, 2011, and Japanese Patent Application No. 2011-025530 filed on Feb. 9, 2011, all of which are hereby incorporated in their entirety by reference.

TECHNICAL FIELD

The presently disclosed subject matter relates to a vehicle light.

BACKGROUND ART

Some vehicle lights such as vehicle headlights are conventionally known to employ a light source which includes a semiconductor light-emitting element and a wavelength conversion material such as a phosphor (for example, see Japanese Patent No. 4124445). In the vehicle light of this type, the phosphor is irradiated with excitation light (for example, blue light) from the semiconductor light-emitting element, so that the light (for example, yellow light) emitted by the phosphor being excited is mixed with the excitation light to transmit a visible radiation (for example, white light), which is then projected as forward illumination for the vehicle through an optical system such as a projection lens.

However, in the aforementioned conventional vehicle light, part of the excitation light may be regularly reflected from the phosphor so as to be transmitted through the projection lens as it is without being mixed with a predetermined color, thus causing partial color variations to occur in the projected image (for example, light distribution pattern).

SUMMARY

The presently disclosed subject matter was devised in view of these and other problems and features and in association with the conventional art. According to an aspect of the presently disclosed subject matter, a vehicle light can prevent color variations of the projected image (for example, light distribution pattern).

According to another aspect of the presently disclosed subject matter, a vehicle light can include a light source including a semiconductor light-emitting element; a wavelength conversion member including a phosphor configured to receive excitation light emitted from the semiconductor light-emitting element and then emitting visible light; a projection lens configured to project the visible light emitted from the wavelength conversion member to provide forward illumination for a vehicle; and a diffusing portion provided to the projection lens, configured to diffuse the excitation light which is incident on the projection lens from the wavelength conversion member.

The vehicle light with the above configuration can further include a condensing optical system configured to focus the excitation light having been emitted from the semiconductor light-emitting element on one surface of the wavelength conversion member. In the vehicle light, the projection lens can be disposed to be opposed to the one surface of the wavelength conversion member, and the diffusing portion can be formed at a portion of the projection lens which is illuminated with the excitation light condensed by the condensing optical system and then regularly reflected from the wavelength conversion member.

Alternatively, the vehicle light with the above configuration can further include a condensing optical system configured to focus the excitation light having been emitted from the semiconductor light-emitting element on one surface of the wavelength conversion member. In the vehicle light, the projection lens can be disposed to be opposed to the other surface of the wavelength conversion member, and the diffusing portion can be formed at a portion of the projection lens which is illuminated with the excitation light condensed by the condensing optical system and then passed through the wavelength conversion member.

According to still another aspect of the presently disclosed subject matter, a vehicle light can include a light source including a semiconductor light-emitting element; a wavelength conversion member including a phosphor configured to receive excitation light emitted from the semiconductor light-emitting element and then emitting visible light; a reflector disposed to cover the wavelength conversion member from the rear side of the wavelength conversion member to above the wavelength conversion member so as to reflect the visible light emitted from the wavelength conversion member to provide forward illumination. In the vehicle light with the above configuration, the wavelength conversion member can be disposed to receive the excitation light from a forward and obliquely upward position, and can have an inclined surface so that the excitation light that is regularly reflected from the surface of the wavelength conversion member can be directed rearward to be incident on a rear end portion of the reflector.

In the vehicle light with the above configuration, the rear end portion of the reflector can be formed at and below the level of the wavelength conversion member so that all or most of the excitation light that has been regularly reflected from the surface of the wavelength conversion member can be incident on the reflector.

In the vehicle light with any of the above configurations, the rear end portion of the reflector can include a condenser reflection surface that can condense on and reflect to the wavelength conversion member the excitation light that has been regularly reflected from the surface of the wavelength conversion member.

According to further another aspect of the presently disclosed subject matter, a vehicle light can include a light source including a semiconductor light-emitting element; a wavelength conversion member including a phosphor configured to receive excitation light emitted from the semiconductor light-emitting element and then emitting visible light; a reflector disposed to cover the wavelength conversion member from the rear side of the wavelength conversion member to above the wavelength conversion member so as to reflect the visible light emitted from the wavelength conversion member to provide forward illumination. In the vehicle light with the above configuration, the wavelength conversion member can be disposed to receive the excitation light from a rear side thereof, and can have an inclined surface so that the excitation light that is regularly reflected from the surface of the wavelength conversion member can be directed to a region positioned forward and obliquely upward with respect to the wavelength conversion member and forward of the reflector, the region where a light distribution pattern formed by the vehicle light is not influenced.

The vehicle light with the above configuration can further include a condenser reflection surface that can be disposed in the region where the excitation light regularly reflected from the surface of the wavelength conversion member is directed, the condenser reflection surface being able to condense on and reflect to the wavelength conversion member the excitation light.

In the vehicle light with the above configuration, the condenser reflection surface can be integrally formed with the reflector.

In the vehicle light with any of the above configurations, the semiconductor light-emitting element can emit a laser beam.

According to one aspect of the presently disclosed subject matter, the projection lens can include the diffusing portion configured to diffuse excitation light incident upon the projection lens at the diffusing portion from the wavelength conversion member. Thus, when part of the excitation light that has not been turned into visible light in the phosphor of the wavelength conversion member and is incident upon the projection lens, that part of excitation light can be diffused in the diffusing portion. It is thus possible to prevent the excitation light from being transmitted through the projection lens at the same strength as that at which the excitation light has been emitted from the semiconductor light-emitting element, in turn preventing color variations of the projected image.

According to another aspect of the presently disclosed subject matter, part of the excitation light that has not been turned into visible light in the phosphor is the light that has been incident upon the surface of the phosphor of the wavelength conversion member from a forward and obliquely upward position with respect thereto and regularly reflected rearward from the surface, and accordingly, the light can be reflected from the rear end portion of the reflector to be incident again onto the phosphor. It is thus possible to prevent the excitation light having been regularly reflected from the surface of the phosphor from being projected directly onto a light distribution pattern, in turn preventing color variations of the light distribution pattern.

According to still another aspect of the presently disclosed subject matter, part of the excitation light that has not been turned into visible light in the phosphor is the light that has been incident upon the surface of the phosphor of the wavelength conversion member from a rearward position with respect to the wavelength conversion member and regularly reflected forward and obliquely upward from the surface. Accordingly, the light can be thereby directed to a region positioned forward and obliquely upward with respect to the wavelength conversion member and forward of the reflector where the light cannot influence the light distribution pattern. It is thus possible to prevent the excitation light having been regularly reflected from the surface of the phosphor from being projected directly onto a light distribution pattern, in turn preventing color variations of the light distribution pattern.

BRIEF DESCRIPTION OF DRAWINGS

These and other characteristics, features, and advantages of the presently disclosed subject matter will become clear from the following description with reference to the accompanying drawings, wherein.

DETAILED DESCRIPTION OF EXEMPLARY EMBODIMENTS

Figure 1:
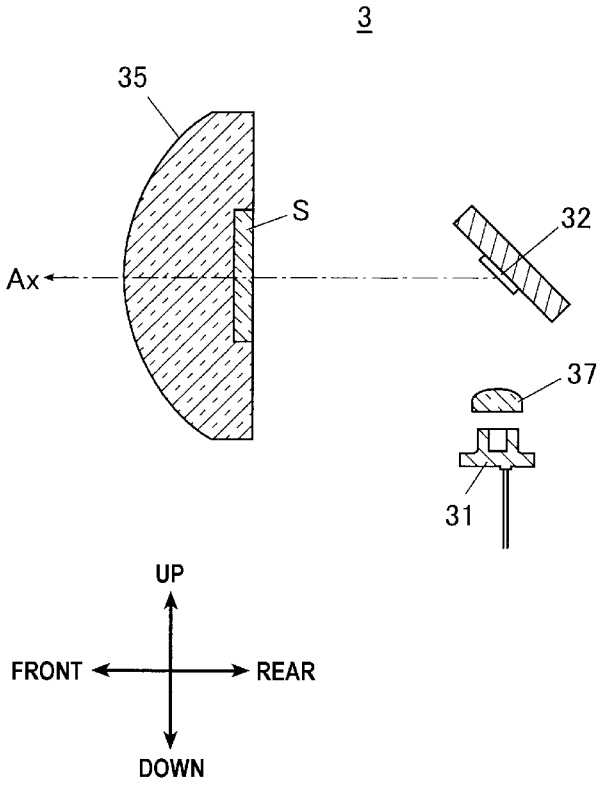
FIG. 1 is a cross-sectional side view illustrating a vehicle light according to an exemplary embodiment made in accordance with principles of the presently disclosed subject matter.

A description will now be made below to vehicle lights of the presently disclosed subject matter with reference to the accompanying drawings in accordance with exemplary embodiments.

It should be noted that the directions of "upper (up)," "lower (down)," "forward (front)," "rearward (back, rear)," "right," and "left" are based on the direction when seen from the vehicle light of each exemplary embodiments and correspond to the indications in the drawings unless otherwise specified.

FIG. 1 is a cross-sectional side view illustrating a vehicle light 3 according to an exemplary embodiment of the presently disclosed subject matter.

As illustrated, the vehicle light 3 is what is called a direct-projection type headlight. The vehicle light 3 can include a light source including a laser diode (hereinafter referred to as the LD) 31, a condenser lens 37, a wavelength conversion member including a phosphor 32, and a projection lens 35.

Among these components, the LD 31 can be the semiconductor light-emitting element according to the presently disclosed subject matter which can upwardly emit a blue laser beam or the excitation light for the phosphor 32. Furthermore, the LD 31 can have a laser outlet which can be elongated in the left to right direction (in a direction perpendicular to the paper surface of FIG. 1) and thus can emit a laser beam that is widened in the left to right direction.

The condenser lens 37 is a condensing optical system which can be disposed above the LD 31 and can focus the blue light, which has been emitted upwardly from the LD 31, on the main surface of the phosphor 32 disposed further above. To be more specific, the condenser lens 37 can focus the blue light from the LD 31 generally at the center of the phosphor 32 in the direction of thickness thereof through the main surface thereof.

The phosphor 32 can be a fluorescence material that is a wavelength conversion material and can be excited by receiving the blue light emitted from the LD 31 to thereby emit yellow light. The phosphor 32 can be disposed above the condenser lens 37 with the main surface inclined downwardly in the forward direction. When the phosphor 32 receives the blue light, the blue light scattered in the phosphor 32 can be mixed with yellow light emitted from the phosphor 32, thereby allowing white light to be radially emitted. The phosphor 32 can also receive on the main surface thereof the blue light from the LD 31, the blue light being condensed by the condenser lens 37. The phosphor 32 can then radially emit white light in the forward direction from the main surface. The main surface can be formed to have generally the same area as that of the condensed spot of the blue light. Accordingly, the phosphor 32 can emit the white light as if the light is emitted from a point light source that has generally the same size as that of the condensed spot of the blue light.

The projection lens 35 can be an aspherical plano-convex lens with a convex front surface. The projection lens 35 can be disposed in front of the phosphor 32 in a manner such that the rear surface thereof is diagonally opposed to the main surface of the phosphor 32 so that the phosphor 32 is located on an optical axis Ax of the projection lens 35 in the back-and-forth direction. The projection lens 35 can have an object-side focal point located at or near the phosphor 32 to project the white light emitted from the phosphor 32 as forward illumination for the vehicle.

The projection lens 35 can also have a diffusing portion S formed on the rear surface thereof. The diffusion portion S can be provided with microscopic asperities. Specifically, the diffusing portion S can be formed at a portion of the rear surface of the projection lens 35 which is illuminated with the blue light condensed by the condenser lens 37 and then regularly reflected from the phosphor 32 (see FIG. 2A). The diffusing portion S can be configured to diffuse the blue light incident on the projection lens 35 which has not been turned into white light by the phosphor 32 but simply regularly reflected therefrom in addition to the white light.

Figure 2A:
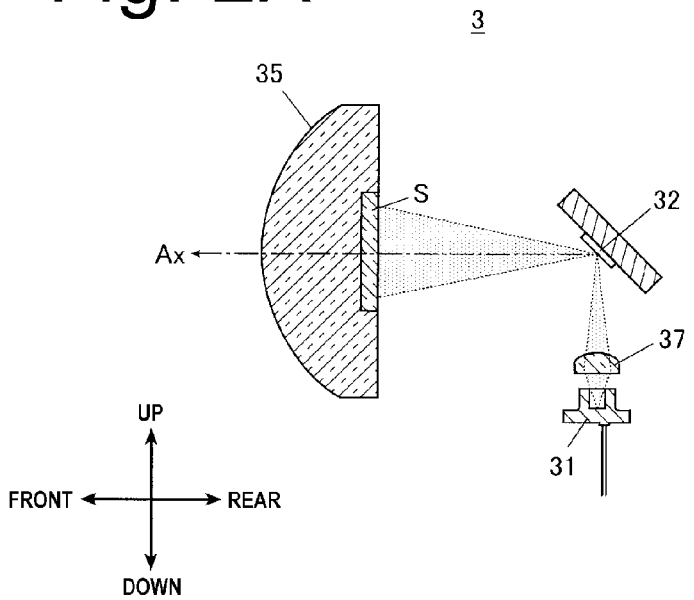
FIGS. 2A and 2B are explanatory views illustrating an optical path of the vehicle light according to the exemplary embodiment of FIG. 1.
Figure 2B:
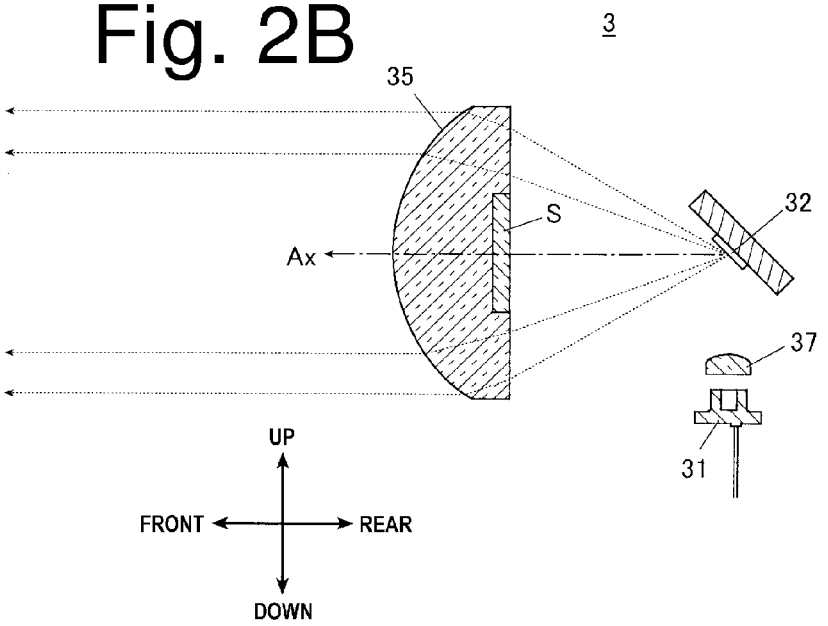

FIGS. 2A and 2B are explanatory views illustrating the optical path of the vehicle light 3.

As shown in FIG. 2A, in the vehicle light 3 configured as described above, the blue light (excitation light) emitted from the LD 31 can be focused on the phosphor 32 by the condenser lens 37 so that most of the blue light can be emitted forward as white light via wavelength-conversion and mixing with yellow light. At this time, part of the blue light focused on the phosphor 32 may not be turned into white light but simply regularly reflected from the phosphor 32 and then directed to the projection lens 35. However, that part of blue light can be incident upon the diffusing portion S of the rear surface of the projection lens 35, and is diffused. Accordingly, it is possible to prevent the blue light from being transmitted through the projection lens 35 at the same strength as that at which the blue light has been emitted from the LD 31.

As shown in FIG. 2B, the white light emitted from the phosphor 32 can be provided by the projection lens 35 as forward illumination for the vehicle.

According to the vehicle light 3 described above, the blue light which has not been turned into white light but simply regularly reflected from the phosphor 32 can be diffused by the diffusing portion S. This makes it possible to prevent the blue light from being transmitted through the projection lens 35 at the same strength at which the blue light has been emitted from the LD 31, which in turn can prevent color variations of the projected image.

Furthermore, in terms of safety (eye safety) for the human body, the blue laser beam light would not necessarily be emitted out of the vehicle light. In this context, the blue light can be prevented from being transmitted through the projection lens 35 at the same high strength at which the blue light has been emitted from the LD 31, thus enhancing the safety.

Next, a description will be made to another exemplary embodiment of the presently disclosed subject matter. Note that the same components as those of the aforementioned exemplary embodiment will be denoted with like reference numerals and will not be repeatedly explained.

Figure 3:
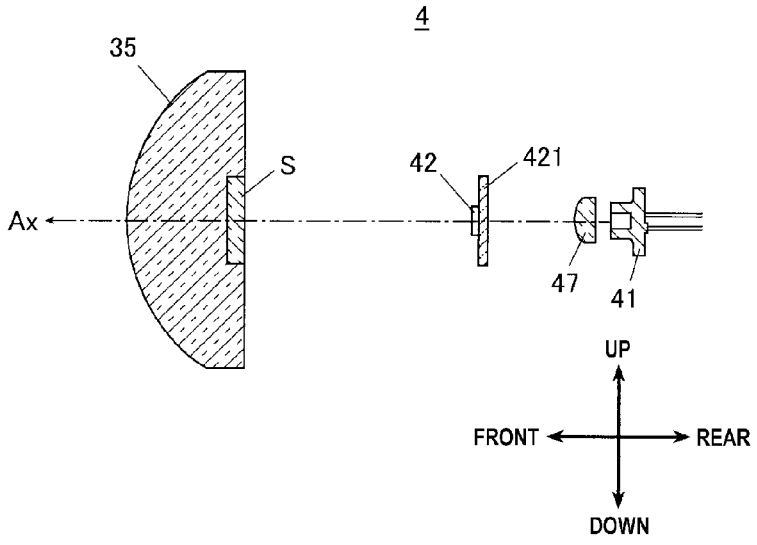
FIG. 3 is a cross-sectional side view illustrating a vehicle light according to another exemplary embodiment.

FIG. 3 is a cross-sectional side view illustrating a vehicle light 4 according to another exemplary embodiment of the presently disclosed subject matter.

As illustrated in this figure, the vehicle light 4 can include an LD 41, a condenser lens 47, and a wavelength conversion member including a phosphor 42 as well as the projection lens 35 that is configured in the same manner as in the aforementioned exemplary embodiment of FIG. 1. The vehicle light 4 is different from the vehicle light 3 of the aforementioned exemplary embodiment of FIG. 1 in that the blue light can be passed through the rear surface of the phosphor 42 in the forward direction.

The LD 41 can be disposed to emit the blue light in the forward direction, and the other arrangements are provided in the same manner as for the LD 31 of the aforementioned exemplary embodiment of FIG. 1.

The condenser lens 47 is the condensing optical system of the presently disclosed subject matter, and can be disposed in front of the LD 41 in a manner such that the blue light emitted from the LD 41 in the forward direction is focused on the rear surface of the phosphor 42 that is disposed at a further forward position. To be more specific, the condenser lens 47 can focus the blue light from the LD 41 generally at the center of the phosphor 42 in the direction of thickness through the rear surface thereof.

The phosphor 42 can be formed of the same fluorescence material as that for the phosphor 32 of the aforementioned exemplary embodiment of FIG. 1, and disposed at a forward position of the condenser lens 47 with the rear surface supported by an optically transparent member 421. The phosphor 42 can be arranged in a manner such that the front surface thereof is directly opposed to the rear surface of the projection lens 35 so that the phosphor 42 can receive, through the rear surface, the blue light from the LD 41 condensed by the condenser lens 47 and then radially emit white light to the projection lens 35 that is located at a further forward position. The phosphor 42 can also be arranged in a manner such that the blue light which has been condensed by the condenser lens 47 and then passed through the phosphor 42 in the forward direction can illuminate the portion of the rear surface of the projection lens 35 at which the diffusing portion S is formed (see FIG. 4A). The phosphor 42 can also be formed so that the areas of the front surface thereof and the rear surface thereof are generally the same as the condensed spot area of the blue light.

Figure 4A:
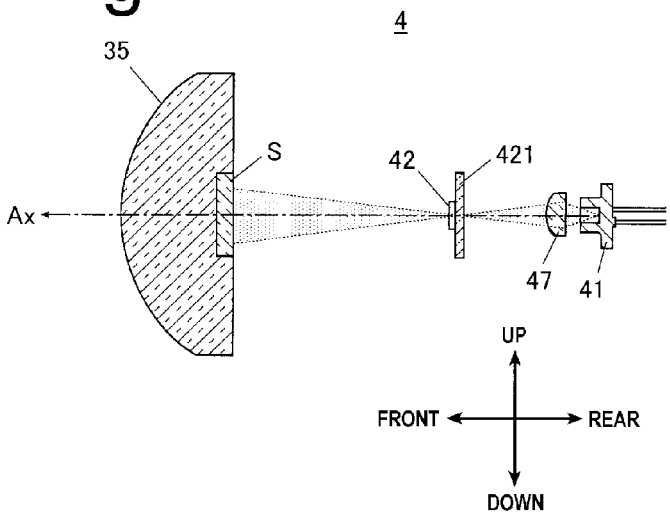
FIGS. 4A and 4B are explanatory views illustrating an optical path in the vehicle light of FIG. 3.
Figure 4B:
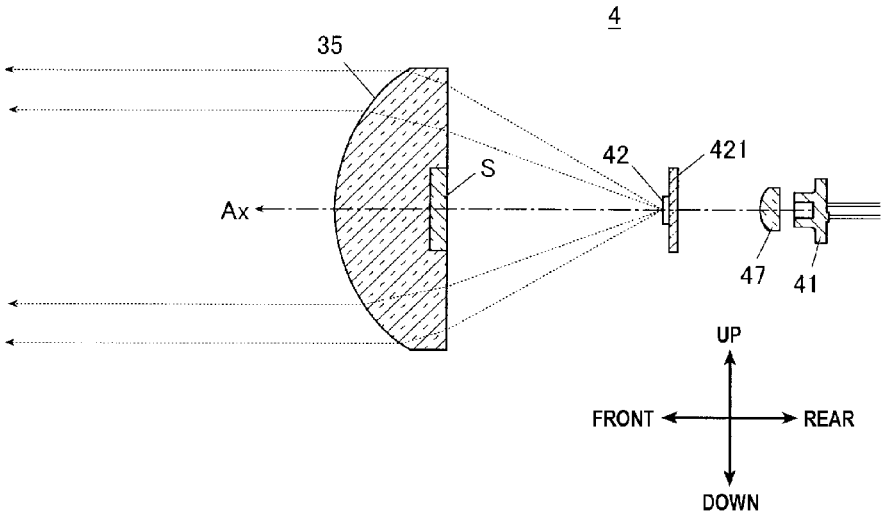

FIGS. 4A and 4B are explanatory views illustrating the optical path of the vehicle light 4.

As shown in FIG. 4A, in the vehicle light 4 configured as described above, the blue light (excitation light) emitted from the LD 41 can be focused on the phosphor 42 by the condenser lens 47 and then most of the blue light can be converted and emitted forward as white light. At this time, part of the blue light focused on the phosphor 42 cannot be turned into white light but passed through the phosphor 42 to be directed to the projection lens 35. However, since that part of blue light that is incident upon the diffusing portion S of the rear surface of the projection lens 35 can be diffused, it is possible to prevent the blue light from being transmitted through the projection lens 35 at the same strength as that at which the light has been emitted from the LD 41.

Accordingly, as shown in FIG. 4B, the white light emitted from the phosphor 42 can be provided as forward illumination for the vehicle through the projection lens 35.

The vehicle light 4 described above can provide the same effects as those by the vehicle light 3 of the aforementioned exemplary embodiment of FIG. 1. That is, the blue light which has not been turned into white light by the phosphor 42 but passed through the phosphor 42 can be diffused by the diffusing portion S. Accordingly, it is possible to prevent the blue light from being transmitted through the projection lens 35 at the same strength at which the blue light has been emitted from the LD 41, which in turn can prevent color variations of the projected image as well as ensure safety for the human body.

While the presently disclosed subject matter has been described with reference to the certain exemplary embodiments, it is to be understood by those skilled in the art that modifications and variations are obviously possible in light of the above teaching, and the presently disclosed subject matter may be practiced otherwise than as specifically described.

For example, although the LDs 31 and 41 have been taken for illustration purposes as the semiconductor light-emitting element of the presently disclosed subject matter, the semiconductor light-emitting element is not limited to the laser diode but may also be, for example, a light-emitting diode.

Furthermore, in the aforementioned embodiments, the LDs 31 and 41 are configured to emit blue light and the blue light can cause the phosphors 32 and 42 to emit yellow light. The presently disclosed subject matter is not limited thereto and may employ other arrangements (a combination of the excitation light and the phosphor) which can provide white light. Furthermore, the light emitted from the phosphors 32 and 42 is not limited to white light, but may also be a visible radiation of other colors for use in vehicles such as automobiles.

Furthermore, in the embodiments above, the diffusing portion S can be formed at a portion of the rear surface of the projection lens 35 which is illuminated with the blue light regularly reflected from the phosphor 32 or the blue light passed through the phosphor 42. However, the diffusing portion S may not need to be formed across that entire portion. More specifically, depending on the output of the regularly reflected or transmitted blue light, taking color variations of the projected image or effects exerted on safety into account, the diffusing portion S may be formed only in a range smaller than the portion which is illuminated with the aforementioned blue light. For example, the diffusing portion S may be formed so as to reduce the peak power of the blue light emitted from the LDs 31 and 41 to a half value.

Figure 5:
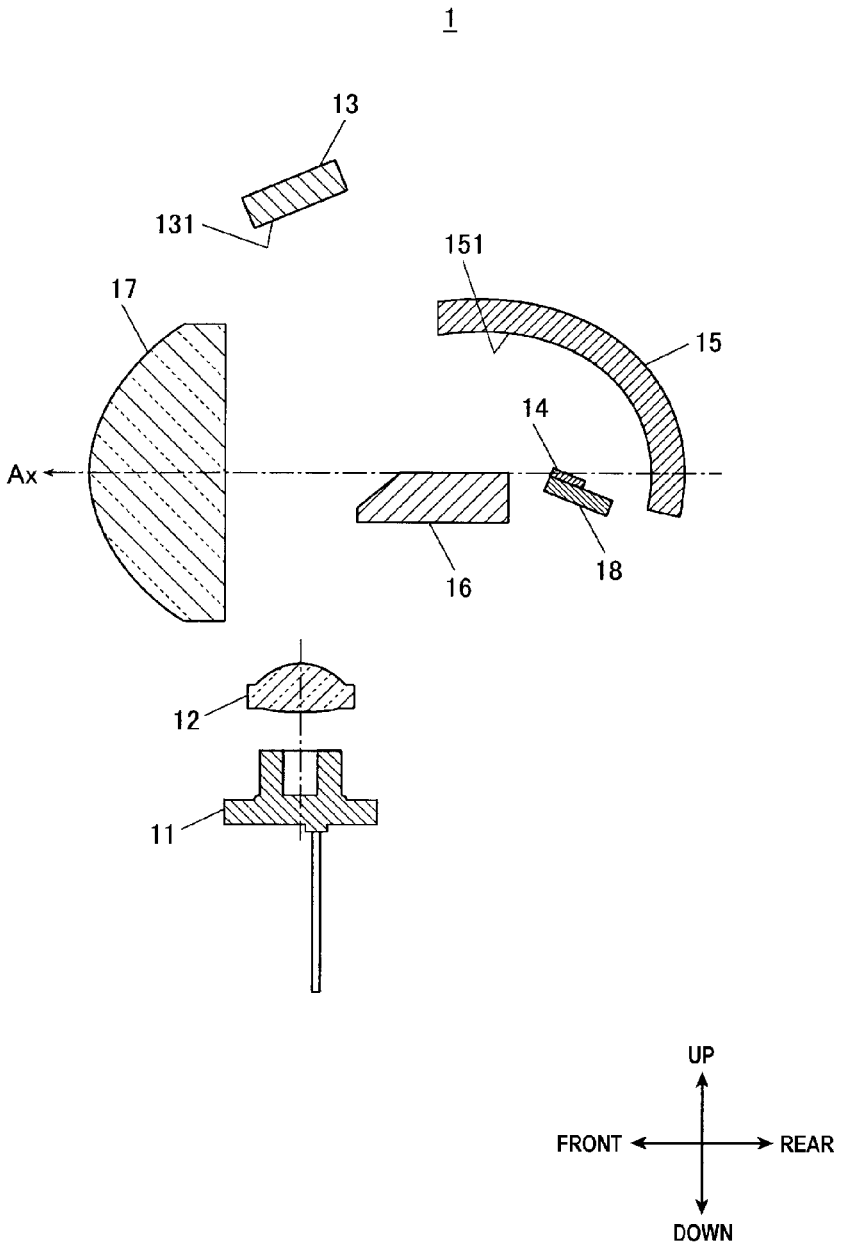
FIG. 5 is a cross-sectional side view illustrating a vehicle light according to another exemplary embodiment made in accordance with principles of the presently disclosed subject matter.

FIG. 5 is a cross-sectional side view illustrating a vehicle light 1 according to another exemplary embodiment of the presently disclosed subject matter.

As illustrated, the vehicle light 1 is what is called a projection type headlight. The vehicle light 1 can include a light source including a laser diode (hereinafter referred to as the LD) 11, a condenser lens 12, a mirror 13, a wavelength conversion member including a phosphor 14, a reflector 15, a shade 16, and a projection lens 17.

Among these components, the LD 11 can be the semiconductor light-emitting element of the presently disclosed subject matter which can upwardly emit a blue laser beam or the excitation light for the phosphor 14.

The condenser lens 12 can be disposed directly above the LD 11 and can focus the blue light, which has been emitted upwardly from the LD 11, on the surface (top surface) of the phosphor 14 via the mirror 13 that is disposed further above. To be more specific, the condenser lens 12 can focus the blue light from the LD 11 generally at the center of the phosphor 14 in the direction of thickness thereof through the surface thereof.

The mirror 13 can be disposed above the condenser lens 12, and can include a planar reflecting surface 131 formed on the lower surface thereof. The reflecting surface 131 can be formed to be inclined in the rearward direction at an angle of 22.5 degrees, for example, so that the blue light, which has been emitted upwardly from the LD 11 via the condenser lens 12, can be reflected obliquely downward in the rearward direction at an angle (depression or directivity angle) of 45 degrees, for example.

The phosphor 14 can be disposed obliquely below the mirror 13 in the rearward direction (for example, in the direction at the angle of 45 degrees) and obliquely above the condenser lens 12 in the rearward direction. Further, the phosphor 14 can be disposed with the top surface thereof inclined in the rearward direction at an angle of 22.5 degrees, for example. The phosphor 14 can be a fluorescence material that is a wavelength conversion material and can be excited by receiving the blue light emitted from the LD 11 to thereby emit yellow light. Accordingly, when the phosphor 14 receives the blue light, the blue light scattered in the phosphor 14 can be mixed with yellow light emitted from the phosphor 14, thereby allowing white light to be emitted. The top surface of the phosphor 14 can be formed to have generally the same area as that of the spot of the blue light condensed by the condenser lens 12. Accordingly, the phosphor 14 can emit the white light as if the light is emitted from a point light source that has generally the same size as that of the condensed spot of the blue light. In the present exemplary embodiment, the phosphor 14 can be supported by a support such as a metal plate 18 inclined in the same manner as the phosphor 14. The support metal plate 18 can include a mirror top surface such as an aluminum deposited surface, so that the white light emitted downward from the phosphor 14 can be reflected upward.

The reflector 15 can be formed to be a curved plate and opened obliquely downward in the forward direction as shown in FIG. 5, so that the top of the phosphor 14 can be covered by the reflector 15 with a predetermined space therebetween. The reflector 15 can have a lower surface to be a reflecting surface 151, which can reflect light emitted from the phosphor 14 in the forward direction.

The reflecting surface 151 can be a free curved surface based on a revolved ellipsoid having a first focal point at or near the position of the phosphor 14. The revolved ellipsoid can be formed so that the eccentricity thereof is gradually increased from the vertical cross-section toward the horizontal cross-section. The reflecting surface 151 can be formed so that the top of the phosphor 14 can be covered by the reflecting surface 151 with a predetermined space therebetween from its rear portion to above the phosphor 14. With this configuration, the white light emitted from the phosphor 14 can be focused at or near the front end of the shade 16 by the curve of the reflecting surface 151 shown in the vertical cross-section while being focused gradually in front of the shade 16 by the curve of the reflecting surface 151 shown in the cross-section toward the horizontal cross-section. The reflecting surface 151 can have a rear end portion (lower end) of which level is below the phosphor 14 as shown in FIG. 5.

Accordingly, as described later, the blue light having been regularly reflected from the surface of the phosphor 14 in the rearward direction can be incident on the rear end portion of the reflecting surface 151.

The shade 16 can be a shielding member disposed in the forward direction with respect to the phosphor 14. The shade 16 can be configured to shield part of the white light reflected from the reflecting surface 151 of the reflector 15 so as to form a cut-off line of a low beam light distribution. The shade 16 can be disposed so that its top surface is positioned at a level that substantially coincides with the level of the horizontal plane (perpendicular to the vertical direction) including the optical axis Ax of the projection lens 17. The top surface of the shade 16 can be an aluminum deposited surface as in the metal plate 18. With this configuration, the white light having been reflected from the reflecting surface 151 and incident on the top surface of the shade 16 can be reflected toward the projection lens 17.

The projection lens 17 can be an aspherical plano-convex lens with a convex front surface. The projection lens 17 can be disposed in front of the phosphor 14 and the reflector 15 in a manner such that the top surface of the shade 16 and the phosphor 14 are located on the optical axis Ax of the projection lens 17 in the back-and-forth direction. The projection lens 17 can have an object-side focal point located at or near the front end of the shade 16 to project the white light reflected from the reflecting surface 151 of the reflector 15 as forward illumination for the vehicle while the white light image is inverted.

Figure 6A:
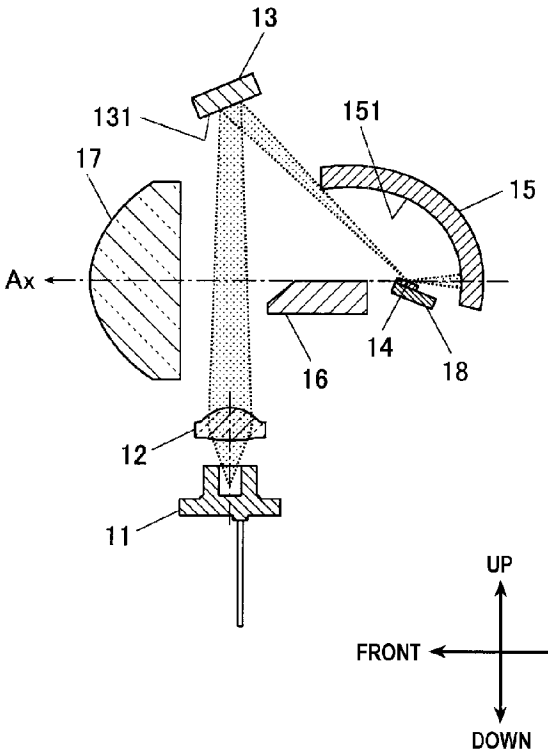
FIGS. 6A and 6B are explanatory views illustrating an optical path of the vehicle light of FIG. 5.
Figure 6B:
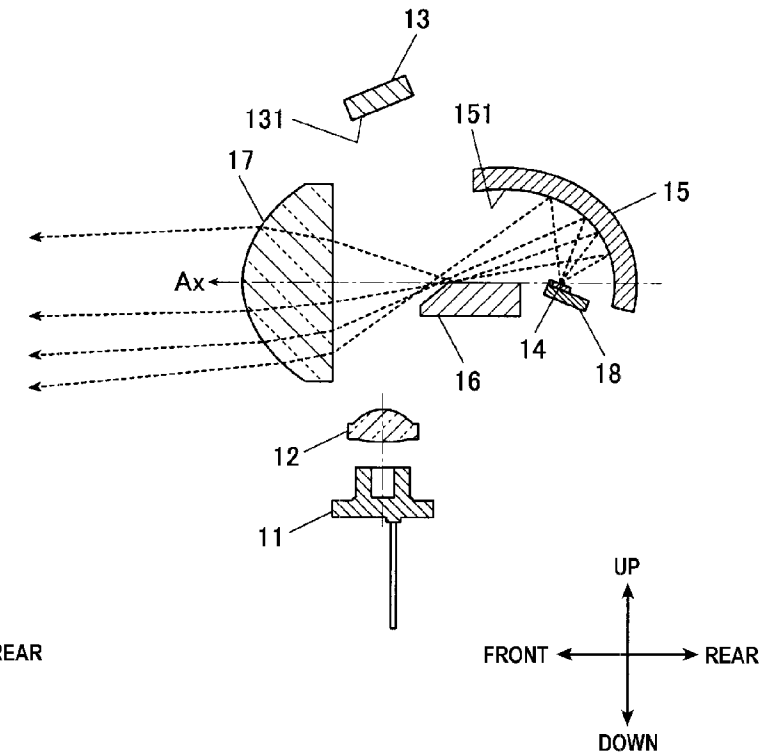

FIGS. 6A and 6B are explanatory views illustrating the optical path of the vehicle light 1 of the present exemplary embodiment.

As shown in FIG. 6A, in the vehicle light 1 configured as described above, the blue light (excitation light) emitted from the LD 11 can be focused by the condenser lens 12 and reflected by the reflecting surface 131 of the mirror 13, so that the blue light can be incident on the top surface of the phosphor 14 from a position obliquely upward in the forward direction with respect to the phosphor 14. At this time, most of the blue light incident on the phosphor 14 can be emitted radially upward as white light. However, part of the blue light may not be turned into white light but simply regularly reflected from the inclined top surface of the phosphor 14 and then directed in the rearward direction along the optical axis Ax. The blue light directed rearward from the phosphor 14 can be incident on the rear end portion of the reflecting surface 151 of the reflector 15 so that the blue light can be reflected from the rear end portion and incident again on the phosphor 14 to be turned into white light. As described above, the reflecting surface 151 can have the rear end portion (lower end) extend below the phosphor 14 as shown in FIG. 5. Accordingly, all or most of the blue light that has been regularly reflected from the surface of the phosphor 14 and spread around the optical axis Ax and directed to the rear side can be incident on the rear end portion of the reflecting surface 151, so that the blue light can be reflected from the reflecting surface 151 toward the phosphor 14.

Further, as shown in FIG. 6B, the white light emitted upward from the phosphor 14 can be reflected from the reflecting surface 151 of the reflector 15 and provided as forward illumination for the vehicle through the projection lens 17. At this time, part of the white light to be directed toward the lower portion of the projection lens 17 can be shielded by the shade 16, so that the desired low beam light distribution having been shielded at or above the cut-off line can be formed.

According to the vehicle light 1 described above, the blue light which is incident on the phosphor 14 from a position obliquely upward in the forward direction with respect to the phosphor 14 and has not been turned into white light but simply regularly reflected from the inclined top surface of the phosphor 14 can be reflected from the rear end portion of the reflecting surface 151. Then, the blue light can be incident again on the phosphor 14 to be turned into white light. This makes it possible to prevent the blue light regularly reflected from the top surface of the phosphor 14 from being projected through the projection lens 17 on the low beam light distribution pattern (projected image of a low beam), which in turn can prevent color variations of the light distribution pattern.

Furthermore, the blue laser beam light can be prevented from being emitted out of the vehicle light, which is a possible solution in terms of ensuring the maximum permissible exposure (MPE).

In addition, the blue light which has been regularly reflected from the top surface of the phosphor 14 can be caused to be incident on the rear end portion of the reflecting surface 151. When compared with a case where blue light is caused to be incident on a central part of the reflecting surface to be returned to a phosphor, the white light can be reflected by means of the entire reflecting surface 151 for forming the low beam light distribution pattern except for the rear end portion thereof. Namely, the portion of the reflecting surface 151 having an intrinsic function of forming a desired light distribution pattern can be utilized without being divided into plural portions. This can facilitate the designing of the reflecting surface 151, leading to the facilitation of the formation of light distribution pattern.

According to the vehicle light 1 described above, the blue light which has not been turned into white light but simply regularly reflected from the top surface of the phosphor 14 can be caused to be incident again on the phosphor 14 to be turned into white light. Accordingly, when compared with the case where such blue light is emitted as it is out of the vehicle light, the vehicle light 1 can enhance the light use efficiency.

Figure 7:
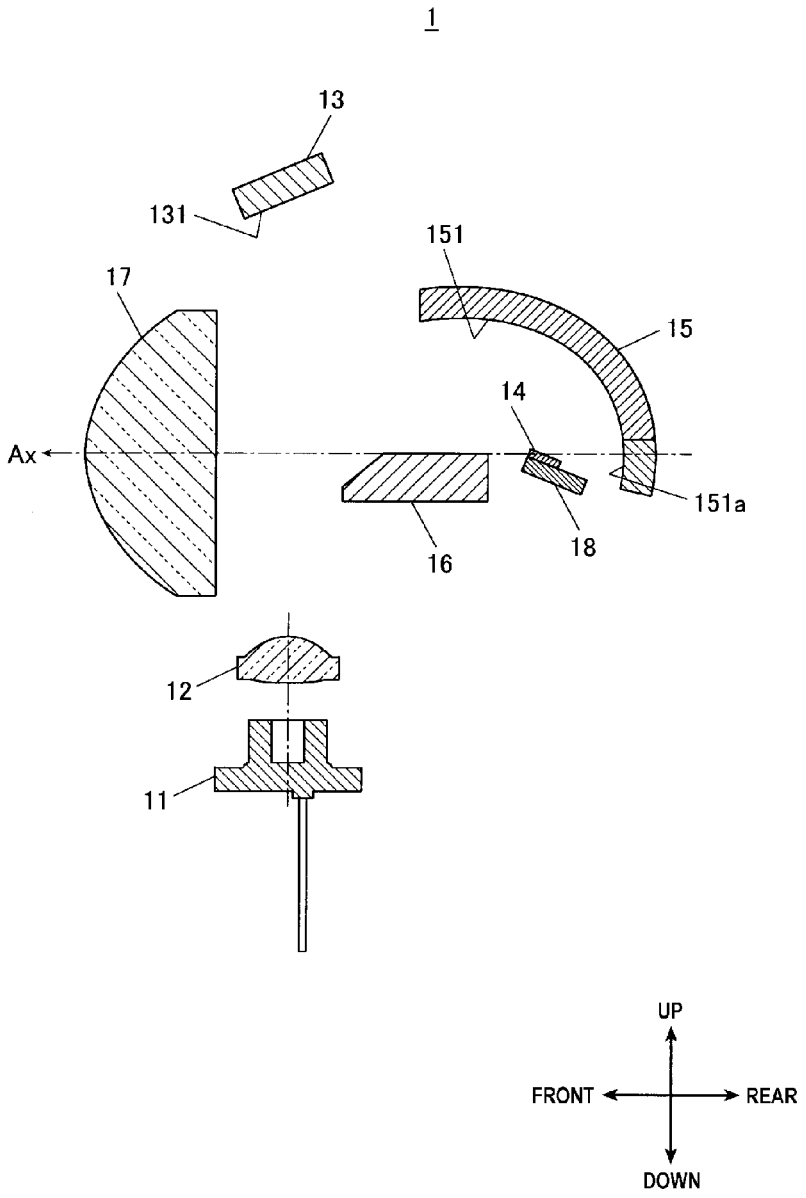
FIG. 7 is a cross-sectional side view illustrating a variation of the vehicle light of FIG. 5.

It should be noted that as shown in FIG. 7 the rear end portion of the reflecting surface 151 can have a condenser reflection surface 151*a* that can reflect the blue light having been regularly reflected from the top surface of the phosphor 14 and condense the blue light onto the phosphor 14. Such a condenser reflection surface 151*a* can gather the blue light from the phosphor 14 and redirect it toward the phosphor 14 to ensure the wavelength conversion into white light. This can enhance the light use efficiency with reliability.

Next, a description will be made to another exemplary embodiment of the presently disclosed subject matter. Note that the same components as those of the aforementioned exemplary embodiment of FIG. 5 will be denoted with like reference numerals and will not be repeatedly explained.

Figure 8:
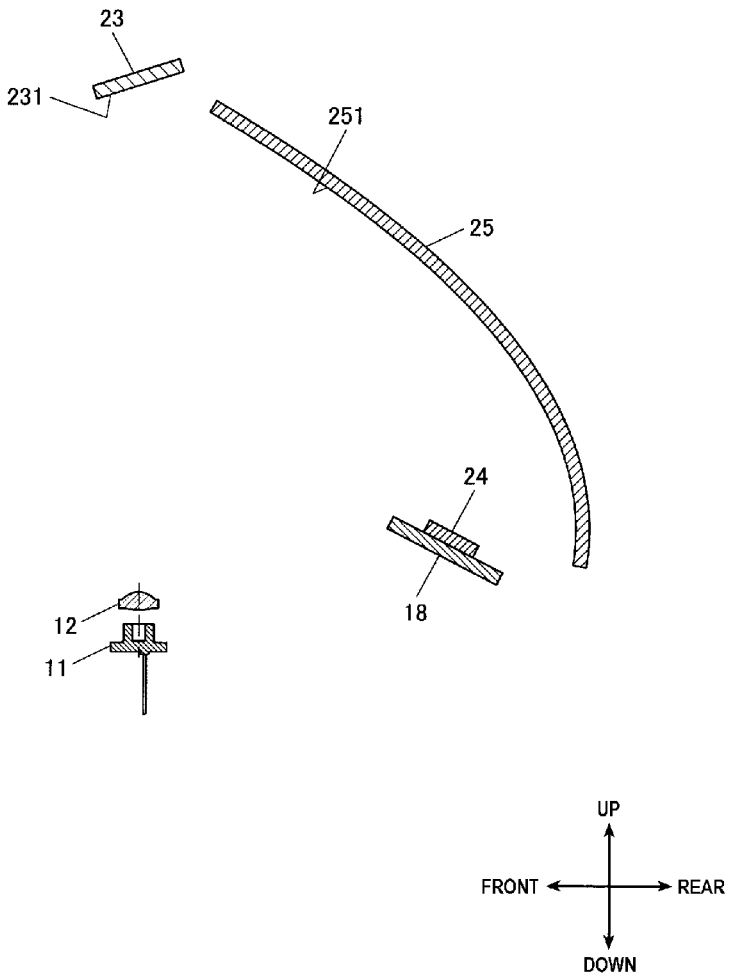
FIG. 8 is a cross-sectional side view illustrating a vehicle light according to another exemplary embodiment.

FIG. 8 is a cross-sectional side view illustrating a vehicle light 2 according to an exemplary embodiment of the presently disclosed subject matter.

As illustrated, the vehicle light 2 is what is called a parabola type headlight. The vehicle light 2 can include an LD 11, a condenser lens 12, a mirror 23, a wavelength conversion member including a phosphor 24, and a reflector 25.

The mirror 23 can be disposed above the condenser lens 12, and can include a planar reflecting surface 231 formed on the lower surface thereof. The reflecting surface 231 can be formed to be inclined in the rearward direction at an angle of 17.5 degrees, for example, so that the blue light, which has been emitted upwardly from the LD 11 via the condenser lens 12, can be reflected obliquely downward in the rearward direction at an angle (depression or directivity angle) of 55 degrees, for example.

The phosphor 24 can be disposed obliquely below the mirror 23 in the rearward direction (in the direction at the angle of 55 degrees) and obliquely above the condenser lens 12 in the rearward direction. Further, the phosphor 24 can be disposed with the top surface thereof inclined in the rearward direction at an angle of 27.5 degrees, for example. The other arrangements of the phosphor 24 are provided in the same manner as for the phosphor 14 of the aforementioned exemplary embodiment of FIG. 5.

The reflector 25 can be formed to be a curved plate and opened obliquely downward in the forward direction as shown in FIG. 8, so that the top of the phosphor 24 can be covered by the reflector 25 with a predetermined space therebetween. The reflector 25 can have a lower surface that is a reflecting surface 251, which can reflect light emitted from the phosphor 24 in the forward direction.

The reflecting surface 251 can be a free curved surface based on a revolved parabola having a focal point at or near the position of the phosphor 24. The reflecting surface 251 can be formed so that the phosphor 24 can be covered therewith at its top with a predetermined space therebetween from its rear portion to above the phosphor 24. The reflecting surface 251 can have a rear end portion (lower end) of which level is below the phosphor 24 as shown in FIG. 8. Accordingly, as described later, the blue light having been regularly reflected from the surface of the phosphor 24 in the rearward direction can be incident on the rear end portion of the reflecting surface 251.

Figure 9B:
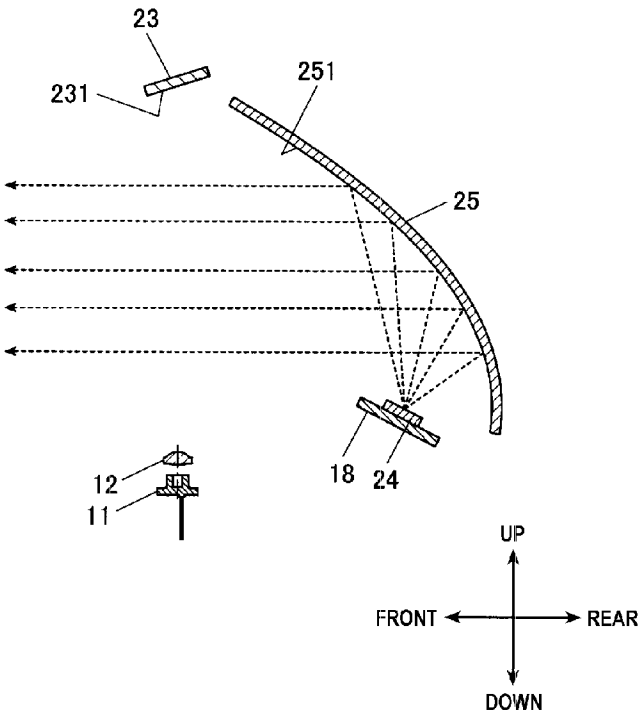
FIGS. 9A and 9B are explanatory views illustrating an optical path in the vehicle light of FIG. 8.
Figure 9A:
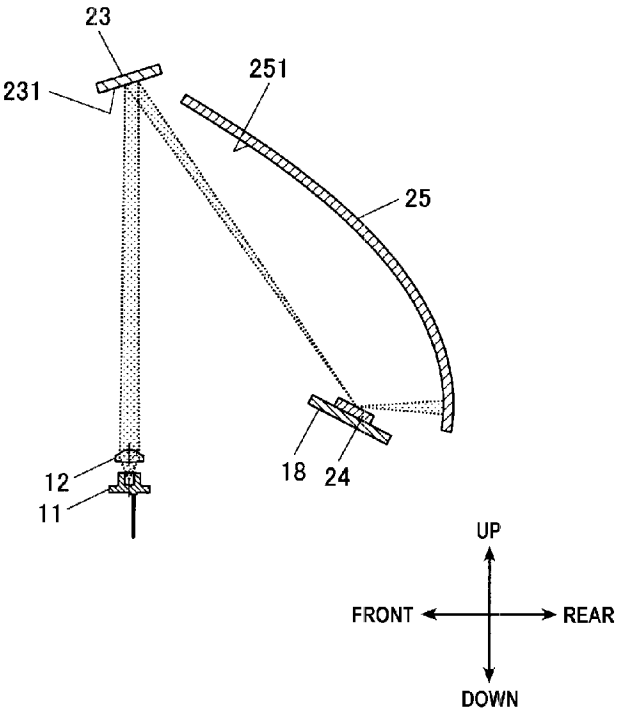

FIGS. 9A and 9B are explanatory views illustrating the optical path of the vehicle light 2.

As shown in FIG. 9A, in the vehicle light 2 configured as described above, the blue light (excitation light) emitted from the LD 11 can be focused by the condenser lens 12 and reflected by the reflecting surface 231 of the mirror 23, so that the blue light can be incident on the top surface of the phosphor 24 from a position obliquely upward in the forward direction with respect to the phosphor 24. At this time, most of the blue light incident on the phosphor 24 can be emitted radially upward as white light. However, part of the blue light may not be turned into white light but simply regularly reflected from the inclined top surface of the phosphor 24 and then directed in the rearward direction. The blue light directed rearward from the phosphor 24 can be incident on the rear end portion of the reflecting surface 251 of the reflector 25 so that the blue light can be reflected from the rear end portion and incident again on the phosphor 24 to be turned into white light. As described above, the reflecting surface 251 can have the rear end portion (lower end) of which level extends below the phosphor 24 as shown in FIG. 8. Accordingly, all or most of the blue light that has been regularly reflected from the surface of the phosphor 24 and spread and directed to the rear side can be allowed to be incident on the rear end portion of the reflecting surface 251, so that the blue light can be reflected from the reflecting surface 251 toward the phosphor 24.

Further, as shown in FIG. 9B, the white light emitted upward from the phosphor 24 can be reflected from the reflecting surface 251 of the reflector 25 and provided as forward illumination for the vehicle to form the desired light distribution pattern (such as a low beam light distribution pattern).

The vehicle light 2 described above can provide the same effects as those by the vehicle light 1 of the aforementioned exemplary embodiment of FIG. 5.

Figure 10:
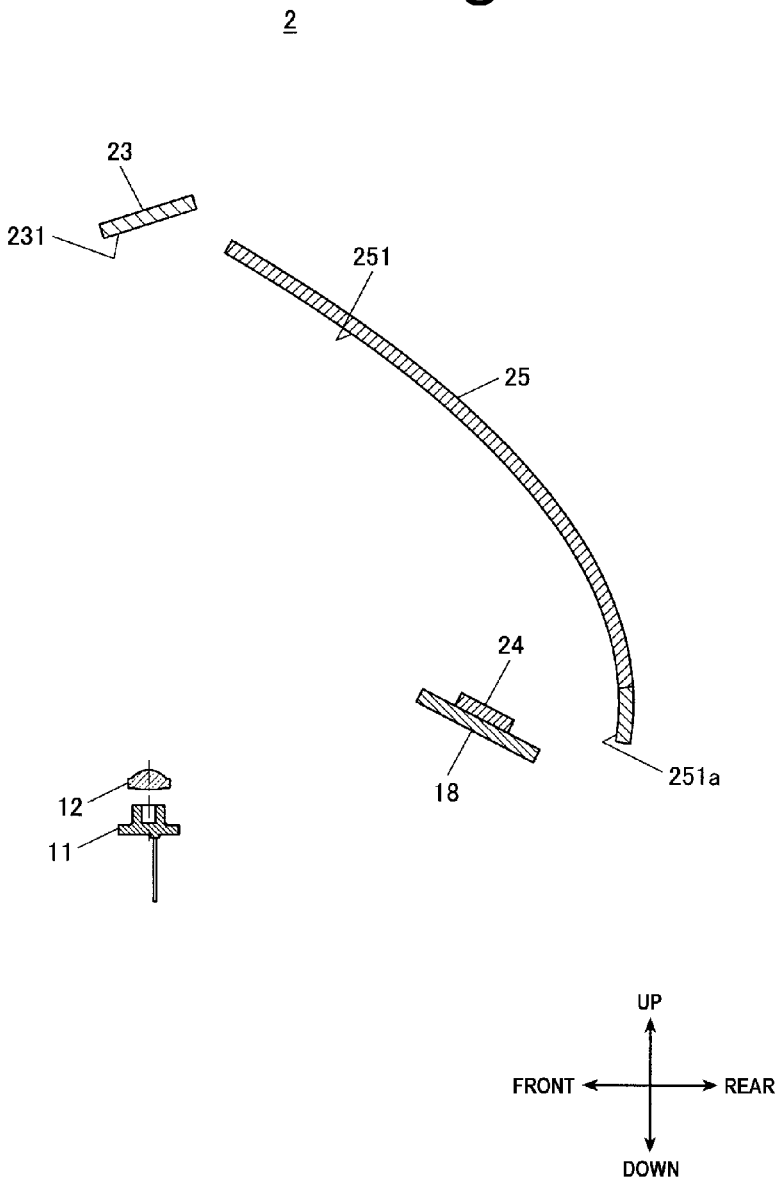
FIG. 10 is a cross-sectional side view illustrating a variation of the vehicle light of FIG. 8.

It should be noted that as shown in FIG. 10 the rear end portion of the reflecting surface 251 can have a condenser reflection surface 251*a* that can reflect the blue light having been regularly reflected from the top surface of the phosphor 24 while condense the blue light onto the phosphor 24 in the same manner as the reflection surface 141 of the exemplary embodiment of FIG. 5.

Figure 11:
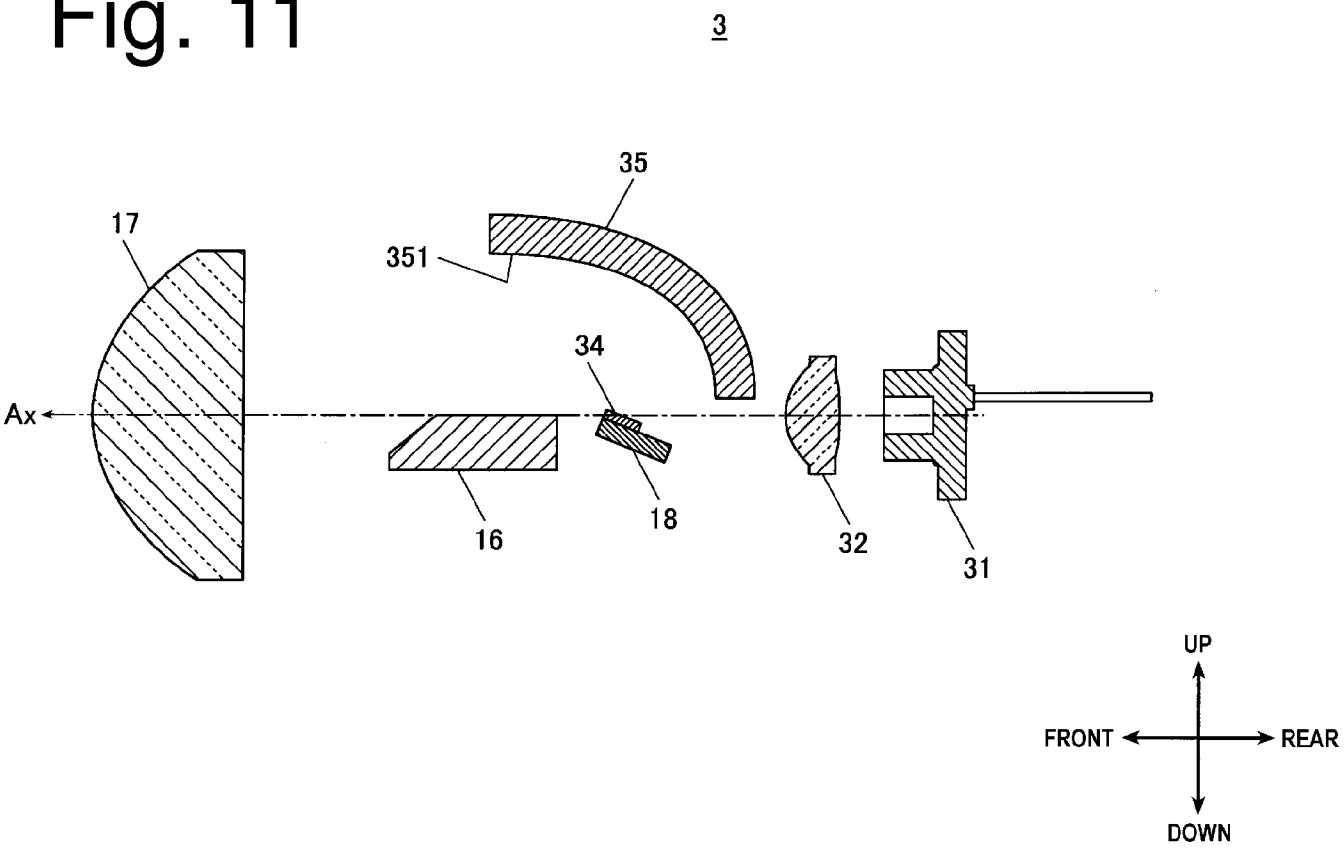
FIG. 11 is a cross-sectional side view illustrating a vehicle light according to another exemplary embodiment made in accordance with principles of the presently disclosed subject matter.

FIG. 11 is a cross-sectional side view illustrating a vehicle light 3 according to another exemplary embodiment of the presently disclosed subject matter.

As illustrated, the vehicle light 3 is what is called a projection type headlight. The vehicle light 3 can include a light source including a laser diode (hereinafter referred to as the LD) 31, a condenser lens 32, a wavelength conversion member including a phosphor 34, a reflector 35, a shade 16, and a projection lens 17.

Among these components, the LD 31 can be the semiconductor light-emitting element of the presently disclosed subject matter which can forwardly emit a blue laser beam or the excitation light for the phosphor 34 along an optical axis Ax of the projection lens 17 described later.

The condenser lens 32 can be disposed in front of the LD 31 and can focus the blue light, which has been emitted forward from the LD 31, on the surface (top surface) of the phosphor 34 disposed in front of the condenser lens 32. To be more specific, the condenser lens 32 can focus the blue light from the LD 31 generally at the center of the phosphor 34 in the direction of thickness thereof through the surface thereof.

The phosphor 34 can be disposed in front of the condenser lens 32. The phosphor 34 can be a fluorescence material that is a wavelength conversion material and can be excited by receiving the blue light emitted from the LD 31 to thereby emit yellow light. Accordingly, when the phosphor 34 receives the blue light, the blue light scattered in the phosphor 34 can be mixed with yellow light emitted from the phosphor 34, thereby allowing white light to be emitted. The top surface of the phosphor 34 can be formed to have generally the same area as that of the spot of the blue light condensed by the condenser lens 32. Accordingly, the phosphor 34 can emit the white light as if the light is emitted from a point light source that has generally the same size as that of the condensed spot of the blue light. In the present exemplary embodiment, the phosphor 34 can be supported by a support such as a metal plate 18 inclined in the same manner as the phosphor 34. The support metal plate 18 can include a mirror top surface such as an aluminum deposited surface, so that the white light emitted downward from the phosphor 34 can be reflected upward.

Further, the phosphor 34 can be disposed with the top surface thereof inclined in the rearward direction at an angle of 22.5 degrees, for example. Accordingly, as described later, the phosphor 34 can be configured such that part of the blue light that is incident from the rear side thereon and been regularly reflected from the surface of the phosphor 34 can be directed to a predetermined region positioned forward and obliquely upward. The predetermined region may be a front region positioned forward and obliquely upward with respect to the phosphor 34 and forward of the reflection surface 351 to be described later, where the light from the phosphor 34 does not influence the formation of a desired light distribution pattern. In the present exemplary embodiment, this region of the phosphor 34 can be defined such that the blue light regularly reflected from this region of the phosphor 34 can be prevented from being emitted out of the vehicle light.

The reflector 35 can be formed to be a curved plate and opened obliquely downward in the forward direction as shown in FIG. 11, so that the phosphor 34 can be covered therewith at its top with a predetermined space therebetween.

The reflector 35 can have a lower surface to be a reflecting surface 351, which can reflect white light emitted from the phosphor 34 in the forward direction.

The reflecting surface 351 can be a free curved surface based on a revolved ellipsoid having a first focal point at or near the position of the phosphor 34. The revolved ellipsoid can be formed so that the eccentricity thereof is gradually increased from the vertical cross-section toward the horizontal cross-section. The reflecting surface 351 can be formed so that the top of the phosphor 34 can be covered by the reflecting surface 351 with a predetermined space therebetween from its rear portion to above the phosphor 34. With this configuration, the white light emitted from the phosphor 34 can be focused at or near the front end of the shade 16 by the curve of the reflecting surface 351 shown in the vertical cross-section while being focused gradually in front of the shade 16 by the curve of the reflecting surface 351 shown in the cross-section toward the horizontal cross-section. The shade 16 can be a shielding member disposed in the forward direction with respect to the phosphor 34. The shade 16 can be configured to shield part of white light reflected from the reflecting surface 351 of the reflector 35 so as to form a cut-off line of a low beam light distribution.

The shade 16 can be disposed so that its top surface is positioned at a level that substantially coincides with the level of the horizontal plane (perpendicular to the vertical direction) including the optical axis Ax of the projection lens 17 to be described later. The top surface of the shade 16 can be an aluminum deposited surface as in the metal plate 18. With this configuration, the white light having been reflected from the reflecting surface 351 and incident on the top surface of the shade 16 can be reflected toward the projection lens 17.

The projection lens 17 can be an aspherical plano-convex lens with a convex front surface. The projection lens 17 can be disposed in front of the phosphor 34 and the reflector 35 in a manner such that the top surface of the shade 16 and the phosphor 34 are located on the optical axis Ax of the projection lens 17 in the back-and-forth direction. The projection lens 17 can have an object-side focal point located at or near the front end of the shade 16 to project the white light reflected from the reflecting surface 351 of the reflector 35 as forward illumination for the vehicle while the white light image is inverted.

Figure 12A:
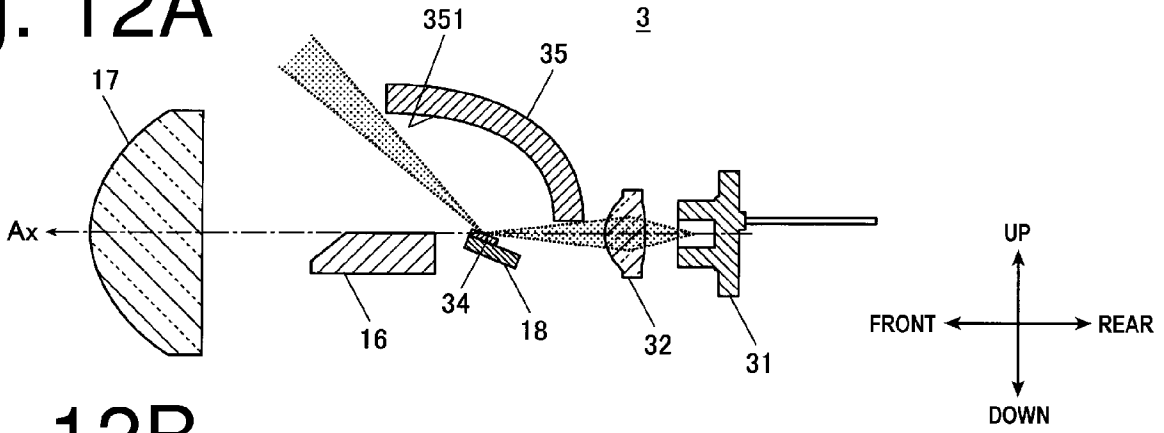
FIGS. 12A and 12B are explanatory views illustrating an optical path of the vehicle light of FIG. 11.
Figure 12B:
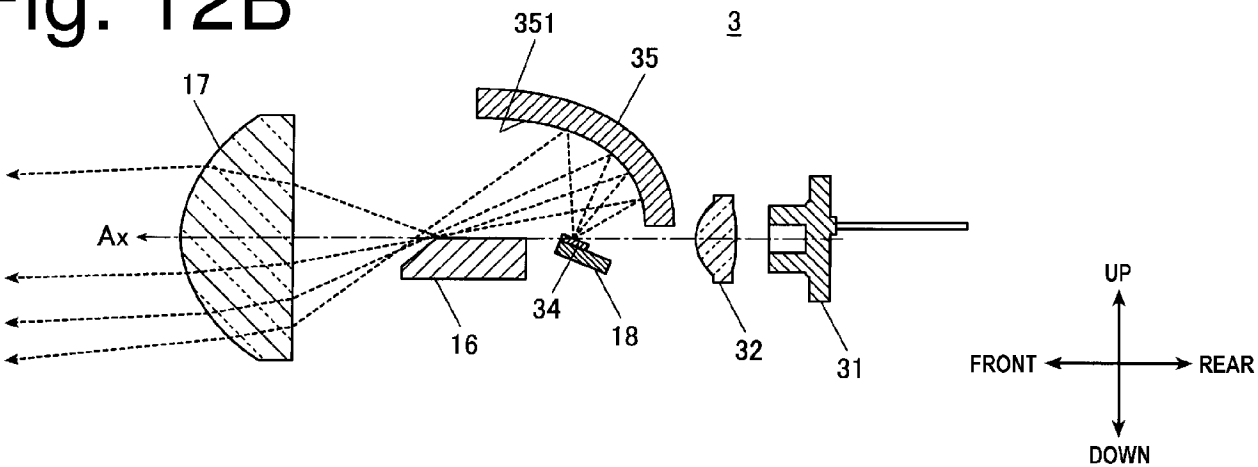

FIGS. 12A and 12B are explanatory views illustrating the optical path of the vehicle light 3 of the present exemplary embodiment.

As shown in FIG. 12A, in the vehicle light 3 configured as described above, the blue light (excitation light) emitted from the LD 31 can be focused by the condenser lens 32, so that the blue light can be incident on the top surface of the phosphor 34 from a rear side with respect to the phosphor 14. At this time, most of the blue light incident on the phosphor 34 can be emitted radially upward as white light. However, part of the blue light may not be turned into white light but simply regularly reflected from the inclined top surface of the phosphor 34, and directed to a predetermined region that is a front region positioned forward and obliquely upward with respect to the phosphor 34 and forward of the reflection surface 351, where the light from the phosphor 34 does not influence the formation of a desired light distribution pattern (such as a low beam light distribution pattern).

Further, as shown in FIG. 12B, the white light emitted upward from the phosphor 34 can be reflected from the reflecting surface 351 of the reflector 35 and provided as forward illumination for the vehicle through the projection lens 17. At this time, part of the white light to be directed toward the lower portion of the projection lens 17 can be shielded by the shade 16, so that the desired low beam light distribution having been shielded at or above the cut-off line can be formed.

According to the vehicle light 3 described above, the blue light which is incident on the phosphor 34 from a rear side and has not been turned into white light but simply regularly reflected from the inclined top surface of the phosphor 34 can be directed to a predetermined region that is a front region positioned forward and obliquely upward with respect to the phosphor 34 and forward of the reflection surface 351, where the light from the phosphor 34 does not influence the formation of a desired light distribution pattern (such as a low beam light distribution pattern). This makes it possible to prevent the blue light regularly reflected from the top surface of the phosphor 34 from being projected through the projection lens 17 on the low beam light distribution pattern (projected image of a low beam), which in turn can prevent color variations of the light distribution pattern.

Furthermore, the blue laser beam light can be prevented from being emitted out of the vehicle light, which is a possible solution in terms of ensuring the maximum permissible exposure (MPE).

Figure 13:
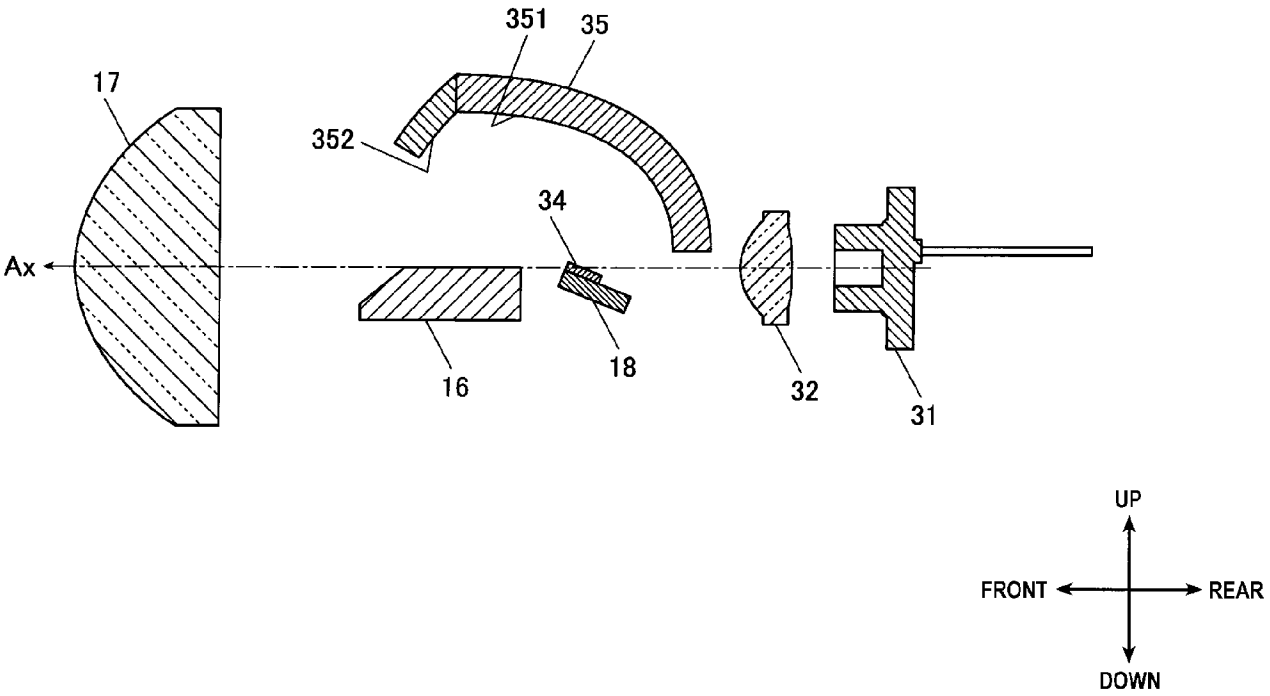
FIG. 13 is a cross-sectional side view illustrating a variation of the vehicle light of FIG. 11.

It should be noted that as shown in FIG. 13 the front end portion of the reflecting surface 351 can have a condenser reflection surface 352 that can reflect the blue light having been regularly reflected from the top surface of the phosphor 34 while condensing the blue light onto the phosphor 34. Such a condenser reflection surface 352 can gather the blue light from the phosphor 34 and redirect it toward the phosphor 34 to ensure the wavelength conversion into white light. This can enhance the light use efficiency. It can be advantageous to form the condenser reflection surface 352 integrally with the reflection surface 351 in view of reduction in the number of parts.

Next, a description will be made to yet another exemplary embodiment of the presently disclosed subject matter. Note that the same components as those of the aforementioned exemplary embodiment of FIG. 11 will be denoted with like reference numerals and will not be repeatedly explained.

Figure 14:
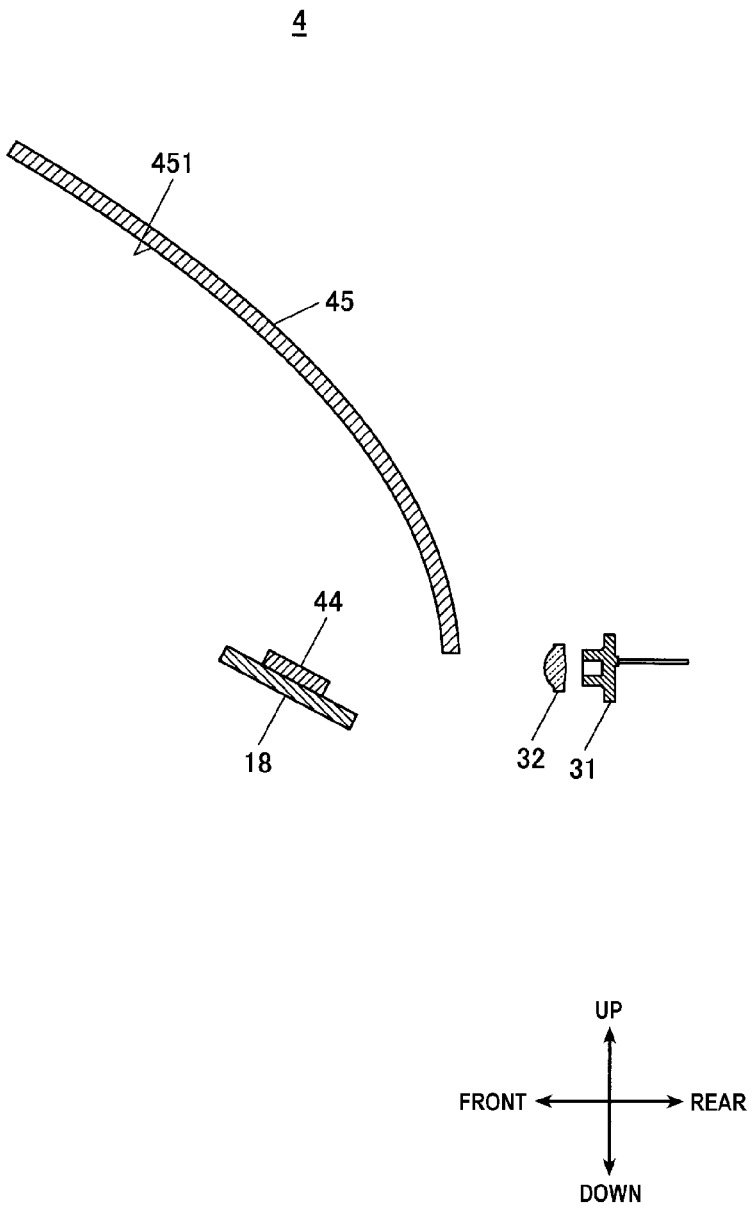
FIG. 14 is a cross-sectional side view illustrating a vehicle light according to another exemplary embodiment.

FIG. 14 is a cross-sectional side view illustrating a vehicle light 4 according to another exemplary embodiment of the presently disclosed subject matter.

As illustrated, the vehicle light 4 is what is called a parabola type headlight. The vehicle light 4 can include an LD 31, a condenser lens 32, a wavelength conversion member including a phosphor 44, and a reflector 45.

Among these components, the phosphor 44 can be disposed in front of the condenser lens 32. The phosphor 44 can have a top surface thereof inclined in the rearward direction at an angle of 27.5 degrees, for example. Accordingly, the phosphor 44 can be configured such that part of the blue light that is incident from the rear side thereon and been regularly reflected from the surface of the phosphor 44 can be directed to a predetermined region positioned forward and obliquely upward. The predetermined region may be a front region positioned forward and obliquely upward with respect to the phosphor 44 and forward of the reflection surface 451 to be described later, where the light from the phosphor 44 does not influence the formation of a desired light distribution pattern. In the present exemplary embodiment, the region can be defined such that the light from the phosphor 44 cannot be emitted out of the vehicle light. The other arrangements of the phosphor 44 are provided in the same manner as for the phosphor 34 of the aforementioned exemplary embodiment of FIG. 11.

The reflector 45 can be formed to be a curved plate and opened obliquely downward in the forward direction as shown in FIG. 14, so that the phosphor 44 can be covered therewith at its top with a predetermined space therebetween. The reflector 45 can have a lower surface to be a reflecting surface 451, which can reflect light emitted from the phosphor 44 in the forward direction.

The reflecting surface 451 can be a free curved surface based on a revolved parabola having a focal point at or near the position of the phosphor 44. The reflecting surface 451 can be formed so that the top of the phosphor 44 can be covered by the reflector surface 451 with a predetermined space therebetween from its rear portion to above the phosphor 24.

Figure 15A:
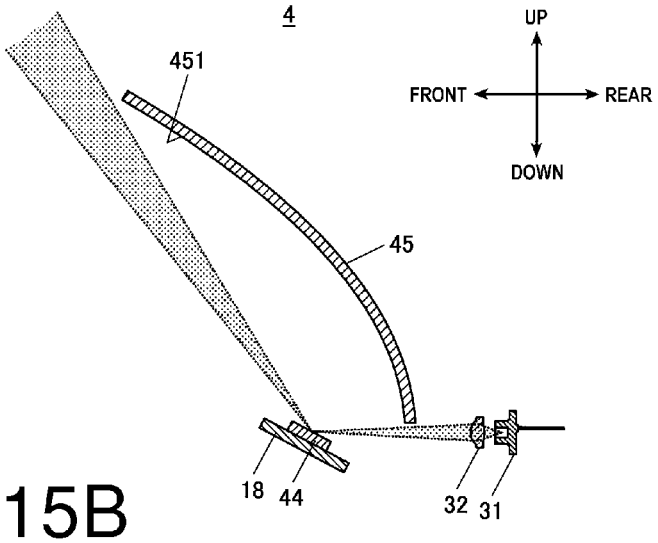
FIGS. 15A and 15B are explanatory views illustrating an optical path in the vehicle light of FIG. 14.
Figure 15B:
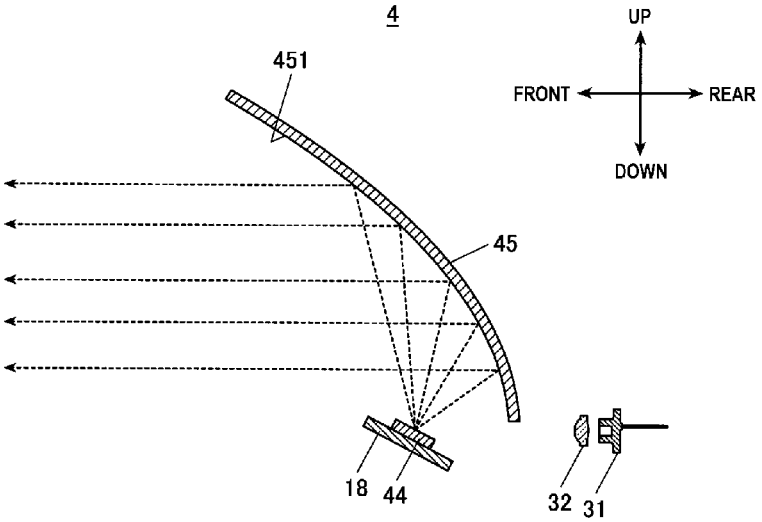

FIGS. 15A and 15B are explanatory views illustrating the optical path of the vehicle light 4.

As shown in FIG. 15A, in the vehicle light 4 configured as described above, the blue light (excitation light) emitted from the LD 31 can be focused by the condenser lens 32, so that the blue light can be incident on the top surface of the phosphor 44 from the rear side with respect to the phosphor 44. At this time, most of the blue light incident on the phosphor 44 can be emitted radially upward as white light. However, part of the blue light may not be turned into white light but simply regularly reflected from the inclined top surface of the phosphor 44, and directed to a predetermined region that is a front region positioned forward and obliquely upward with respect to the phosphor 44 and forward of the reflection surface 451, where the light from the phosphor 44 does not influence the formation of a desired light distribution pattern (such as a low beam light distribution pattern).

Further, as shown in FIG. 15B, the white light emitted upward from the phosphor 44 can be reflected from the reflecting surface 451 of the reflector 45 and provided as forward illumination for the vehicle to form the desired light distribution pattern (such as a low beam light distribution pattern).

The vehicle light 4 described above can provide the same effects as those by the vehicle light 3 of the aforementioned exemplary embodiment of FIG. 11.

Figure 16:
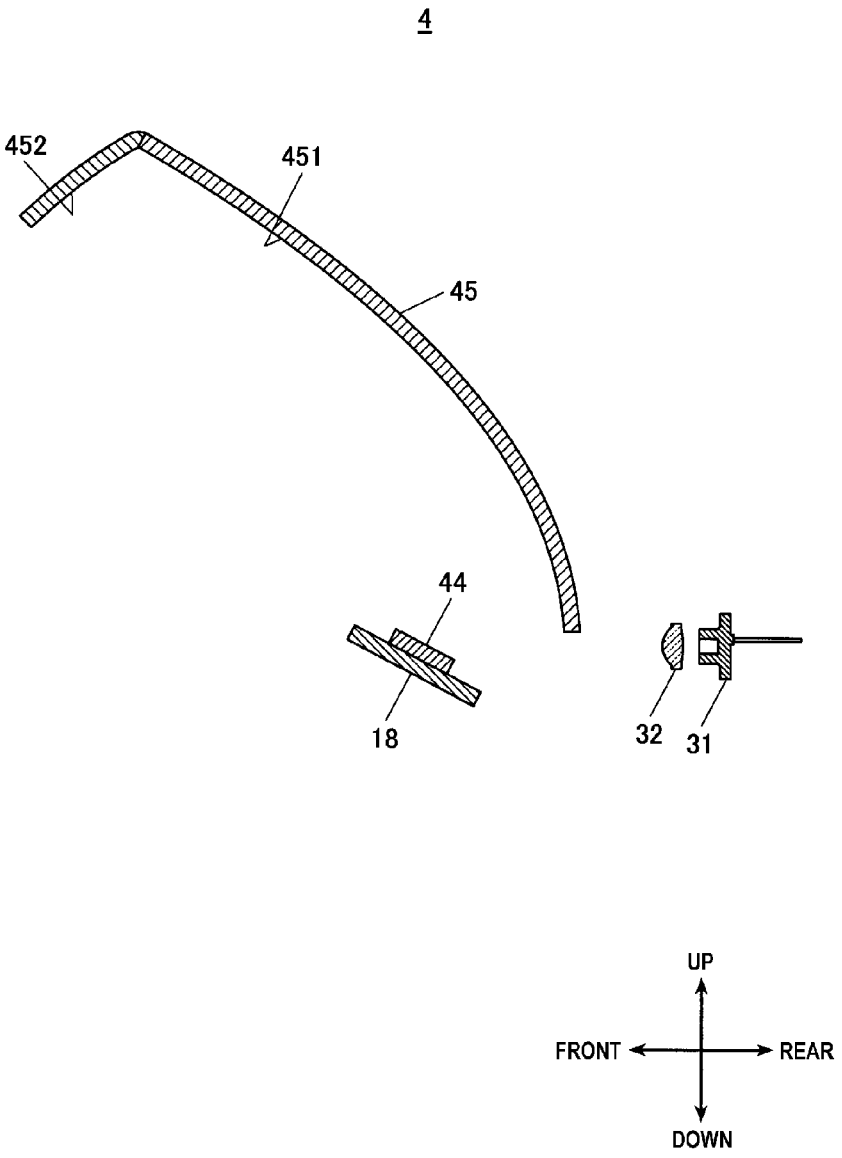
FIG. 16 is a cross-sectional side view illustrating a variation of the vehicle light of FIG. 14.

It should be noted that as shown in FIG. 16 the front end portion of the reflector 45 can have a condenser reflection surface 452 that can reflect the blue light having been regularly reflected from the top surface of the phosphor 44 while condense the blue light onto the phosphor 44. Such a condenser reflection surface 452 can gather the blue light from the phosphor 44 toward the phosphor 44 to ensure the wavelength conversion into white light. This can enhance the light use efficiency. In certain circumstances it can be advantageous to form the condenser reflection surface 452 integrally with the reflection surface 451 in view of reduction in the number of parts.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A projection type vehicle light configured to project light forward, comprising:

a light source including a semiconductor light-emitting element;

a wavelength conversion member including a phosphor configured to receive excitation light emitted from the semiconductor light-emitting element and emit visible light, and a metal plate configured to support the phosphor and have a mirror top surface so that the visible light emitted downward from the phosphor is reflected upward; and a reflector formed to be curved and opened obliquely downward in the forward direction, having a reflecting surface facing downward, and extending from a position adjacent a rear side of the wavelength conversion member to a position above the wavelength conversion member such that the visible light emitted from the wavelength conversion member is reflected to provide forward illumination, wherein:

the wavelength conversion member is disposed to receive the excitation light from a position forward and obliquely upward relative to the wavelength conversion member and includes a surface inclined in a rearward direction toward the reflector such that the excitation light that is regularly reflected from the surface of the wavelength conversion member is directed rearward to be incident on a rear end portion of the reflector, the metal plate is inclined in the rearward direction toward the reflector such that the excitation light through the wavelength conversion member can be reflected by the surface of the metal plate toward the rear end portion of the reflector;

the rear end portion of the reflector extends below a level of the wavelength conversion member such that substantially all the excitation light that has been regularly reflected from the surface of the wavelength conversion member is incident on the reflector, the rear end portion of the reflector includes a condenser reflection surface that is integrally formed with the reflecting surface and configured to condense on and reflect to the wavelength conversion member the excitation light that has been regularly reflected from the surface of the wavelength conversion member;

a projection lens having an optical axis and configured to project the visible light reflected from the reflecting surface forward while inverting an image of the visible light;

the visible light reflected by a central portion of the reflecting surface of the reflector is focused between the phosphor and the projection lens;

the surface of the wavelength conversion member and the metal plate that are inclined are located on the optical axis of the projection lens;

the condenser reflection surface is located on or below the optical axis of the projection lens; and the mirror top surface of the wavelength conversion member is inclined with respect to the optical axis of the projection lens by an angle such that part of the light emitted from the light source is regularly reflected by the mirror top surface to be directed to the condenser reflection surface.

2. The projection type vehicle light according to claim 1, further comprising:

a second reflector disposed substantially at the forward and obliquely upward position and above the light source so as to receive the excitation light that has been emitted from the light source and reflect the excitation light toward the wavelength conversion member.

3. A projection type vehicle light configured to project light forward, comprising:

a light source including a semiconductor light-emitting element;

a wavelength conversion member including a phosphor configured to receive excitation light emitted from the semiconductor light-emitting element and emit visible light, and a metal plate configured to support the phosphor and have a mirror top surface so that the visible light emitted downward from the phosphor is reflected upward; and a reflector formed to be curved and opened obliquely downward in the forward direction, having a reflecting surface facing downward, and extending from a rear side of the wavelength conversion member to a position above the wavelength conversion member such that the visible light emitted from the wavelength conversion member is reflected to provide forward illumination, wherein the wavelength conversion member is positioned to receive the excitation light from a rear side thereof, and has a surface inclined in a rearward direction toward the reflector so that the excitation light that is regularly reflected from the surface of the wavelength conversion member is directed to a region positioned forward and obliquely upward with respect to the wavelength conversion member and forward of the reflector such that the so directed light is separated from a light distribution pattern formed by the vehicle light;

the metal plate is inclined in the rearward direction toward the reflector such that the excitation light through the wavelength conversion member can be reflected by the surface of the metal plate to a region positioned forward and obliquely upward with respect to the wavelength conversion member and forward of the reflector such that the so directed light is separated from a light distribution pattern formed by the vehicle light;

the reflector integrally includes a condenser reflection surface positioned at a front end portion of the reflector in the region where the excitation light regularly reflected from the surface of the wavelength conversion member is directed, the condenser reflection surface configured to condense on and reflect to the wavelength conversion member the excitation light;

a condenser lens configured to focus the excitation light emitted from the semiconductor light-emitting element at a central portion of the phosphor in a thickness direction of the phosphor through the surface of the phosphor so as to form a spot of the excitation light condensed by the condenser lens having generally the same area as that of the surface of the phosphor;

a projection lens having an optical axis and configured to project the visible light reflected from the reflecting surface forward while inverting an image of the visible light;

the visible light reflected by the reflecting surface of the reflector is focused between the phosphor and the projection lens;

the surface of the wavelength conversion member that is inclined and the condenser lens are located on the optical axis of the projection lens; and the mirror top surface of the wavelength conversion member is inclined with respect to the optical axis of the projection lens by an angle such that part of the light emitted from the light source is regularly reflected by the mirror top surface to be directed to the condenser reflection surface.

4. The projection type vehicle light according to claim 1, wherein the semiconductor light-emitting element emits a laser beam.

5. The projection type vehicle light according to claim 3, wherein the semiconductor light-emitting element emits a laser beam.

6. The projection type vehicle light according to claim 1, further comprising:

a diffusing portion provided to the projection lens and configured to diffuse light incident on the projection lens received from the wavelength conversion member.

7. The projection type vehicle light according to claim 3, further comprising:

a diffusing portion provided to the projection lens and configured to diffuse light incident on the projection lens received from the wavelength conversion member.

8. The projection type vehicle light according to claim 3, wherein the wavelength conversion member is positioned to receive the excitation light from a rear side thereof, and has an inclined surface so that the excitation light that is regularly reflected from the surface of the wavelength conversion member is directed to a region positioned forward and obliquely upward with respect to the wavelength conversion member and forward of the reflector such that the so directed light is separated from a light distribution pattern formed by the vehicle light.

9. The projection type vehicle light according to claim 2, further comprising a condenser lens disposed between the semiconductor light-emitting element and the second reflector, the condenser lens configured to focus the excitation light, which is emitted from the semiconductor light-emitting element and reflected by the second reflector, at a central portion of the phosphor through the surface of the phosphor in a thickness direction of the phosphor, and wherein the semiconductor light-emitting element, the condenser lens, and the second reflector are vertically separated from an optical path of the visible light reflected by the reflecting surface of the reflector so that the semiconductor light-emitting element, the condenser lens, and the second reflector do not shield the visible light reflected by the reflecting surface.

* * * * *